US009376944B2

(12) United States Patent
Itoo et al.

(10) Patent No.: US 9,376,944 B2
(45) Date of Patent: Jun. 28, 2016

(54) OIL LEVEL DETECTION MECHANISM

(71) Applicant: KAWASAKI JUKOGYO KABUSHIKI KAISHA, Hyogo (JP)

(72) Inventors: Seiji Itoo, Akashi (JP); Ayumi Hamada, Akashi (JP); Taisuke Morita, Amagasaki (JP)

(73) Assignee: KAWASAKI JUKOGYO KABUSHIKI KAISHA, Hyogo (JP)

( * ) Notice: Subject to any disclaimer, the term of this patent is extended or adjusted under 35 U.S.C. 154(b) by 200 days.

(21) Appl. No.: 14/261,698

(22) Filed: Apr. 25, 2014

(65) Prior Publication Data

US 2015/0308309 A1 Oct. 29, 2015

(51) Int. Cl.
*F01M 11/12* (2006.01)
*F01M 11/10* (2006.01)

(52) U.S. Cl.
CPC ..... *F01M 11/12* (2013.01); *F01M 2011/14* (2013.01)

(58) Field of Classification Search
None
See application file for complete search history.

(56) References Cited

U.S. PATENT DOCUMENTS 4,590,798 A * 5/1986 Yazaki ..... F01M 11/12 116/227
2008/0006086 A1* 1/2008 Tawarada ..... G01F 23/02 73/323
2012/0097482 A1* 4/2012 Miller ..... F01M 11/0458 184/6.4

FOREIGN PATENT DOCUMENTS

JP 11-93634 4/1999
JP 11310935 A * 11/1999

* cited by examiner

*Primary Examiner* — Andre Allen
(74) *Attorney, Agent, or Firm* — Wenderoth, Lind & Ponack, L.L.P.

(57) ABSTRACT

An oil level detection mechanism for detecting an oil level in the inside of a case 91, comprising: an oil filler opening 92 through which oil is supplied into the case 91; and an oil level detection member 93 that is located below a lower end of the oil filler opening 92 in the inside of the case 91 and that protrudes inward from an inner wall 91*a* of the case 91 so that a tip part 93*a* thereof is located in a region visually recognizable from the outside of the oil filler opening 92.

6 Claims, 7 Drawing Sheets

OIL LEVEL DETECTION MECHANISM

BACKGROUND OF THE INVENTION

1. Field of the Invention

The present invention relates to an oil level detection mechanism for detecting the oil level in the inside of a case.

2. Description of the Related Art

In the conventional art, the oil level of engine oil supplied into the transmission case of the transmission of a utility vehicle has been detected by using an oil level gauge of long bar shape inserted into the case as disclosed in Japanese Laid-Open Patent Publication No. H11-93634 or the like.

SUMMARY OF THE INVENTION

Thus, an object of the present invention is to provide an oil level detection mechanism that can detect the oil level in the inside of a case without use of an oil level gauge or the like and that has a simple structure.

In order to achieve the above-mentioned object, a first invention of the present application is characterized by an oil level detection mechanism for detecting an oil level in the inside of a case, comprising:

an oil filler opening through which oil is supplied into the case; and an oil level detection member that is located below a lower end of the oil filler opening in the inside of the case and that protrudes inward from an inner wall of the case so that a tip part thereof is located in a region visually recognizable from the outside of the oil filler opening.

According to the above-mentioned configuration, the oil level in the inside of the case can be checked without use of an oil level gauge or the like.

Preferably, the first invention further employs the following configurations.

(1) The oil level detection member is formed integratedly with the case.

(2) A notch or an opening is formed in the oil level detection member.

(3) In above-mentioned configuration (1), the notch or the opening is formed such that an area of an upper end surface thereof is larger than an area of a lower end surface thereof.

(4) The oil level detection member extends from the inner wall toward an inner side of the case and is inclined downward relative to a horizontal plane.

According to the above-mentioned configuration (1), the oil level detection member can be formed easily.

According to the above-mentioned configuration (2), the oil level in the inside of the case can be recognized visually in three dimensions through the notch or the opening.

According to the above-mentioned configuration (3), rise of the oil level in the inside of the notch or the opening becomes gradual and hence oil level check is achieved more easily.

According to the above-mentioned configuration (4), rise of the oil level in the oil level detection member becomes gradual. Further, oil level can be recognized visually in three dimensions by virtue of the inclination of the oil level detection member.

Further, a second invention of the present application is characterized by an oil level detection mechanism for detecting an oil level in the inside of a case, comprising:

an oil filler opening through which oil is supplied into the case; and an oil level detection member that is located below a lower end of the oil filler opening in the inside of the case and that protrudes inward from an inner wall of the case so that a tip part thereof is located in a region visually recognizable from the outside of the oil filler opening, wherein an oil supply upper limit level is located between a lower end surface and an upper end surface of the oil level detection member.

According to the above-mentioned configuration, the oil level in the inside of the case can be checked without use of an oil level gauge or the like. Further, the oil supply upper limit level is located between the lower end surface and the upper end surface of the oil level detection member. Thus, even when oil is supplied to the upper limit, overflow of the oil through the oil filler opening can be avoided.

In conclusion, the present invention provides an oil level detection mechanism capable of detecting the oil level in the inside of a case without use of an oil level gauge or the like.

DETAILED DESCRIPTION OF THE INVENTION

[Overall Structure of Vehicle]

Figure 1:
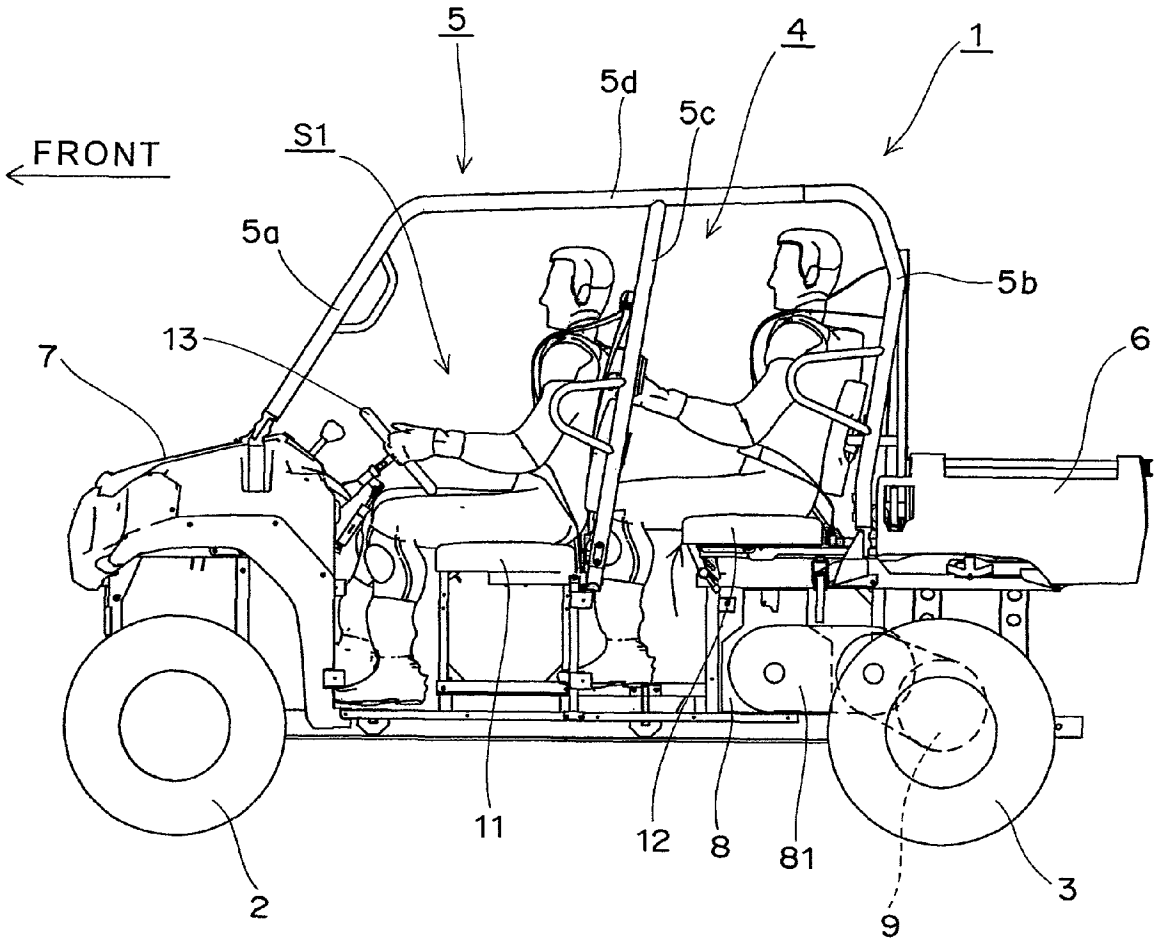
FIG. 1 is a left side view of a utility vehicle according to an embodiment of the present invention.
Figure 2:
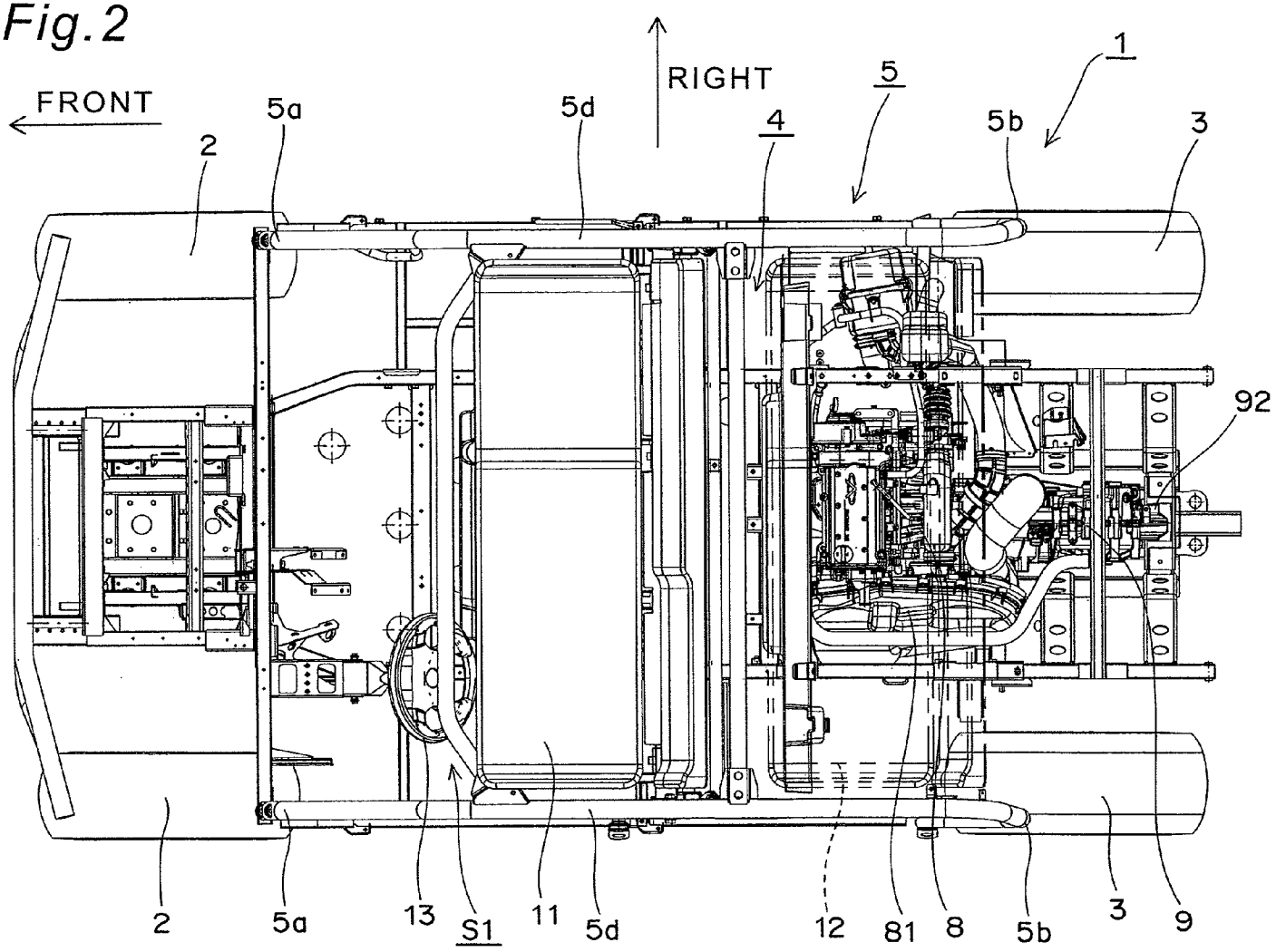
FIG. 2 is a top view of a utility vehicle shown in FIG. 1.

FIG. 1 is a left side view of a utility vehicle according to an embodiment of the present invention. Here, the notation of direction employed in the present embodiment is defined as the same as those viewed from a driver of the utility vehicle. FIG. 2 is a top view of the utility vehicle shown in FIG. 1.

As shown in FIGS. 1 and 2, in the utility vehicle 1, a pair of right and left front wheels 2 are provided in the front part of the vehicle body and a pair of right and left rear wheels 3 are provided in the rear part of the vehicle body. Further, a cabin space (a cabin) 4 is provided between the front wheels 2 and the rear wheels 3. The cabin space 4 is surrounded by a ROPS 5. The ROPS 5 is an abbreviation of a rollover protective structure, which constitutes a part of the vehicle body frame. Then, the ROPS 5 includes: a pair of right and left front vertical members 5*a*; a pair of right and left rear vertical members 5*b*; a pair of right and left intermediate vertical members 5*c* arranged between the front vertical members 5*a* and the rear vertical members 5*b*; and a plurality of upper end beam members 5*d* for linking the upper end parts of the individual vertical members 5*a*, 5*b*, and 5*c*. Then, a loading platform 6 is provided behind the cabin space 4 and a bonnet 7 is provided in front of the cabin space 4. A front sheet 11 of bench type is provided in the frontward half part of the cabin space 4 and a rear sheet 12 of bench type is provided in the rearward half part of the cabin space 4. A sheet region S1 in the left side part of the front sheet 11 is a driver's seat and an operation section such as a steering wheel 13 is provided in front of the left-side sheet region S1.

An engine 8 is arranged under the rear sheet 12. Then, a transmission 9 for converting the driving force from the engine 8 and then transmitting it to the wheels is arranged behind the engine 8. The engine 8 and the transmission 9 are formed separately or integratedly with each other. Then, the driving force of the engine 8 is transmitted to the transmission 9 through a belt converter 81 attached to the left side surface of the engine 8 and the left side surface of the transmission 9. The belt converter 81 includes a V-belt type continuously variable transmission, where automatic transmission control is performed in accordance with the revolving speed of the engine 8 and an increase or decrease of the load on the wheel side.

[Structure of Transmission]

Figure 3:
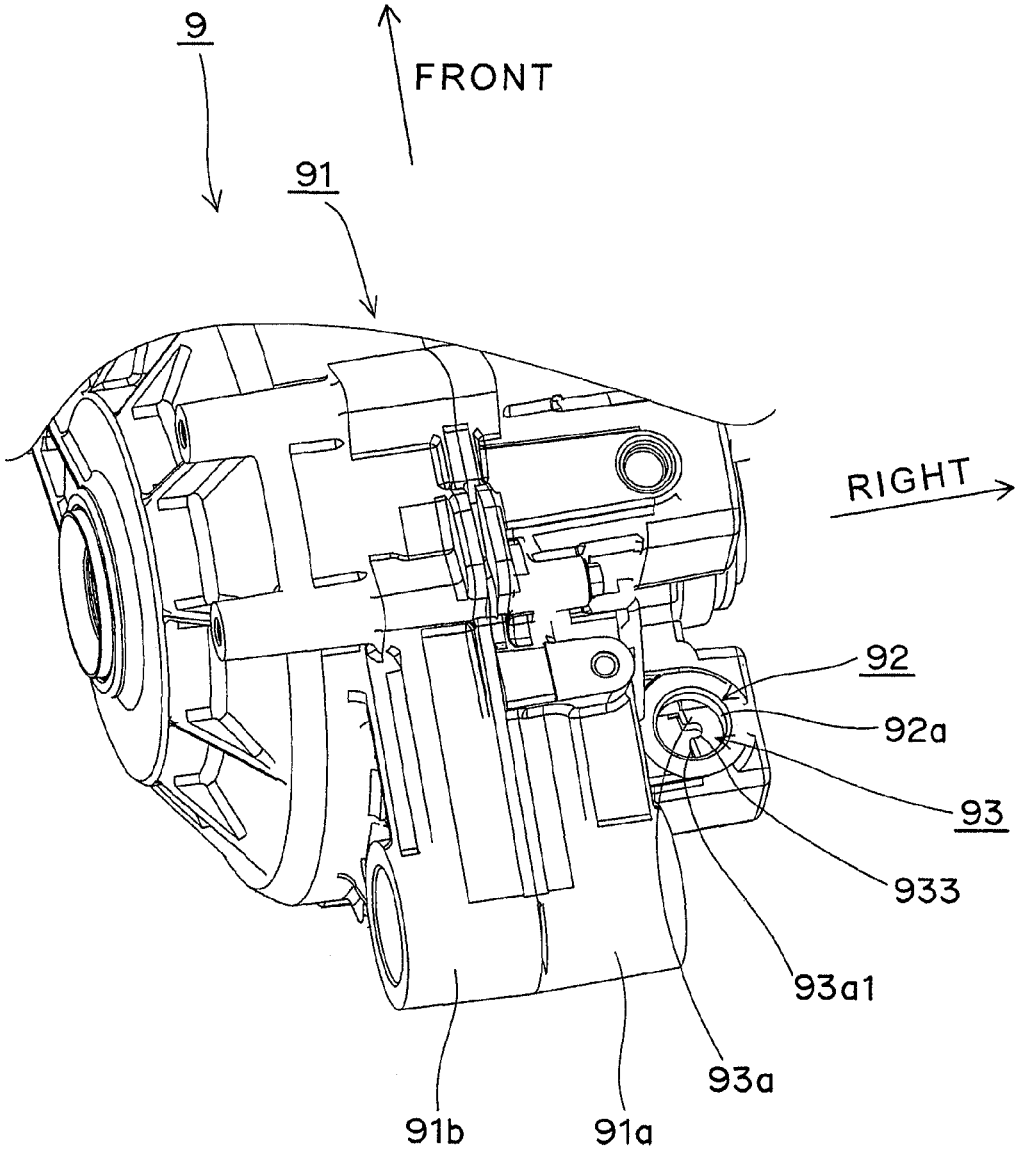
FIG. 3 is a rearward perspective view of a transmission.
Figure 4:
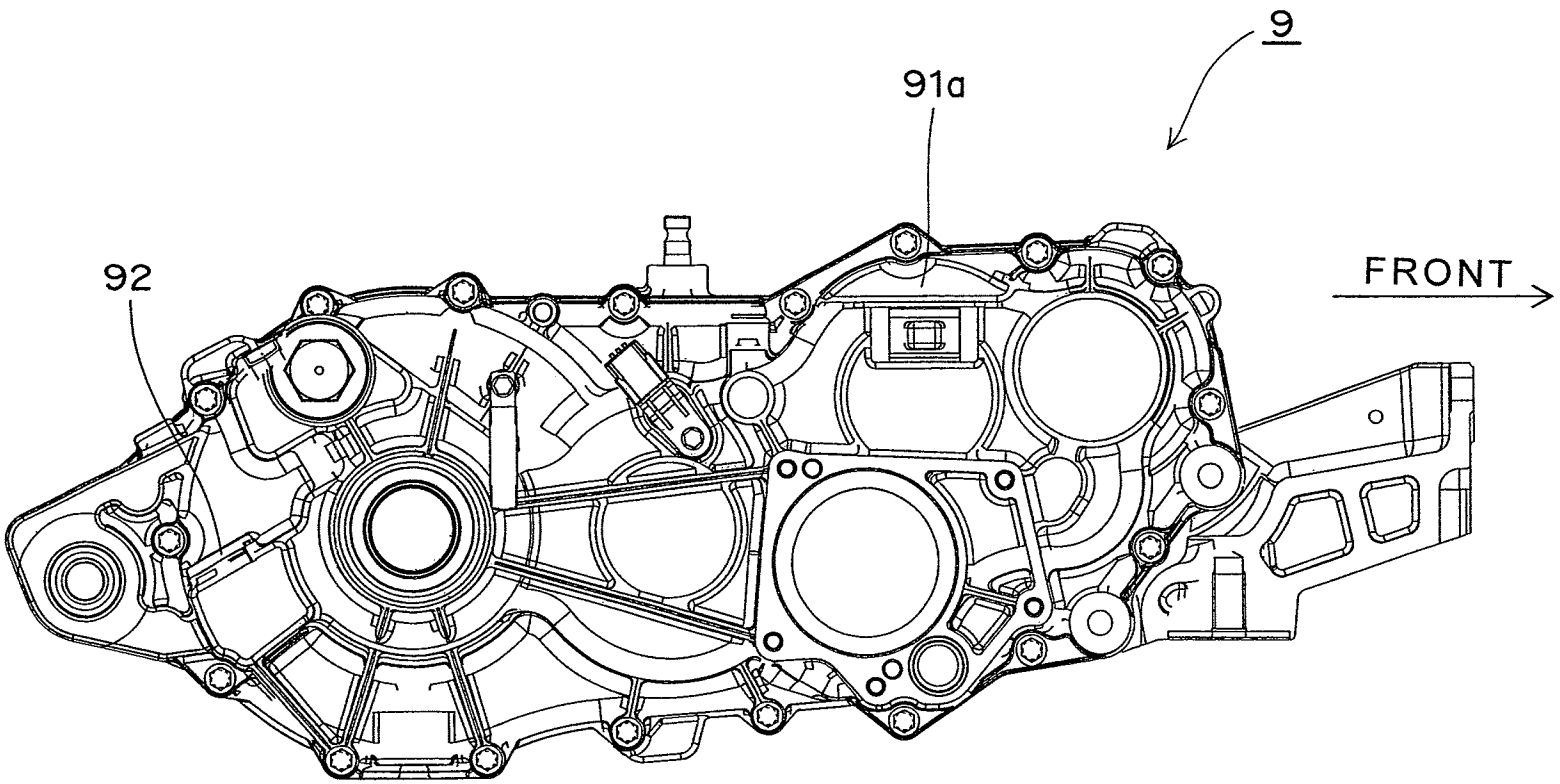
FIG. 4 is a right side view of a transmission case member 91*a;*

FIG. 3 is a rearward perspective view of the transmission 9. As shown in FIG. 3, a transmission case 91 forming the outline of the transmission 9 is fabricated by joining a pair of left and right transmission, case members 91*a* and 91*b* at the central mating surface. FIG. 4 is a right side view of the transmission case member 91*a*. As shown in FIGS. 3 and 4, an oil filler opening 92 through which oil is supplied into the transmission case 91 is formed in the rear part of the transmission case member 91*a*. Then, as shown in FIG. 3, an oil level detection member 93 is provided at a position below the lower end 92*a* of the oil filler opening 92 in the inside of the transmission case 91.

Figure 5:
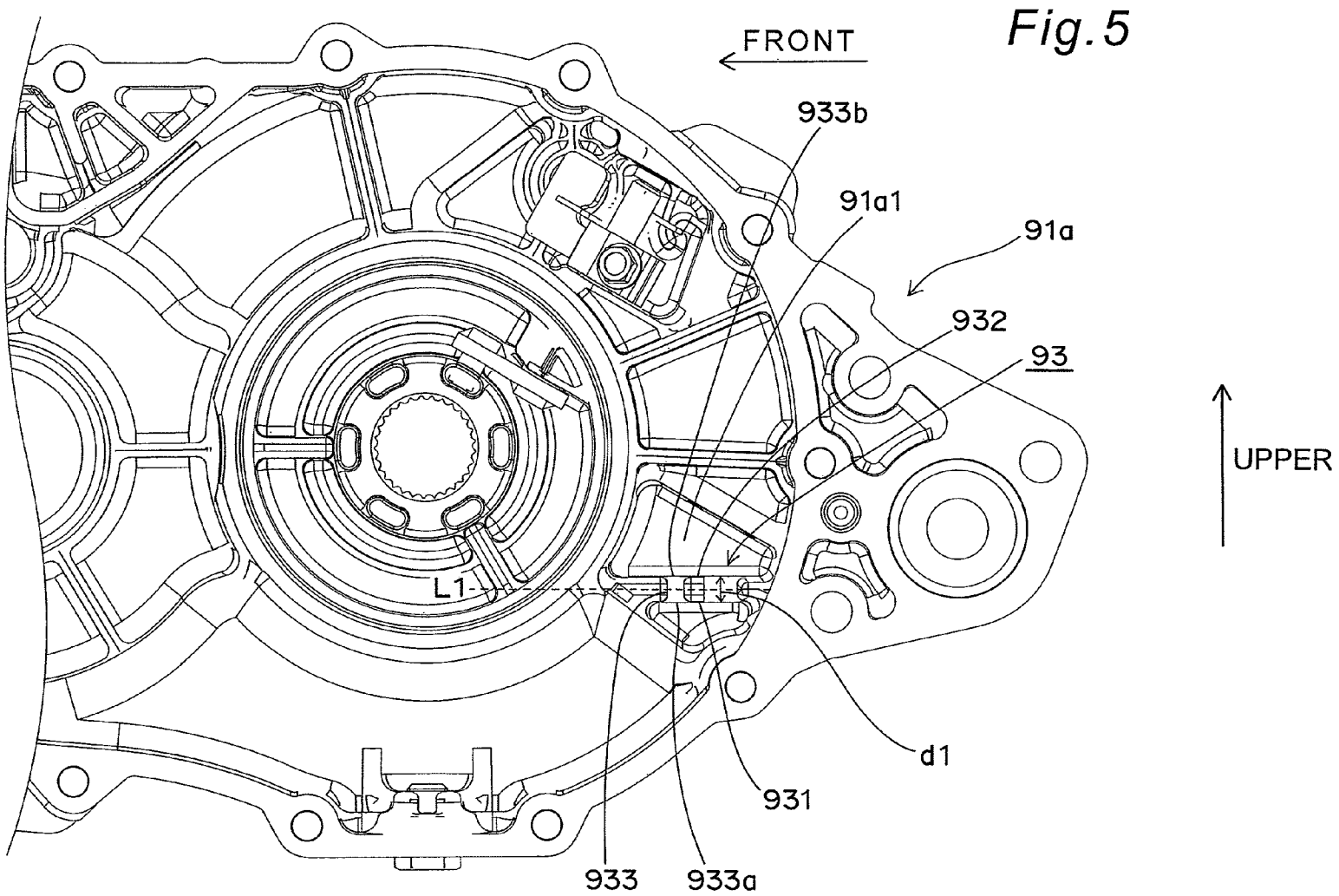
FIG. 5 is an enlarged view of an oil level detection member viewed from the inside of a transmission case.
Figure 6:
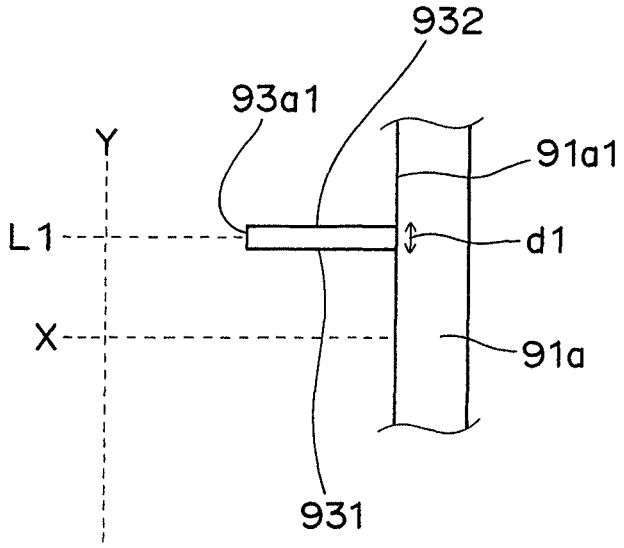
FIG. 6 is a side view of an oil level detection member.

FIG. 5 is an enlarged view of the oil level detection member 93 viewed from the inside of the transmission case 91. FIG. 6 is a side view of the oil level detection member 93. As shown in FIGS. 3, 5, and 6, the oil level detection member 93 protrudes inward from the inner wall 91*a*1 of the transmission case member 91*a*. Then, the tip part 93*a* thereof is located in a region visually recognizable from the outside of the oil filler opening 92. Further, the oil level detection member 93 is formed integratedly with the transmission case member 91*a*. The end surface 93*a*1 of the tip part 93*a* may be perpendicular to a horizontal plane X and also may be inclined relative to a vertical plane Y.

As shown in FIGS. 5 and 6, the oil level detection member 93 has a fixed thickness d1 in the up and down directions. Further, an oil supply upper limit level L1 is located between the lower end surface 931 and the upper end surface 932 of the oil level detection member 93. The thickness d1 of the oil level detection member 93 is approximately 5 mm to 10 mm and, more preferably, approximately 7 mm.

As shown in FIGS. 3 and 5, a notch 933 is formed in the tip part 93*a* of the oil level detection member 93. Then, the notch 933 is formed such that the area of the upper end surface 933*b* thereof is larger than the area of the lower end surface 933*a* thereof.

As shown in FIG. 6, the oil level detection member 93 extends from the inner wall 91*a*1 of the transmission case 91*a* toward the inner side of the transmission case 91*a* and is approximately in parallel to the horizontal plane X.

According to the utility vehicle 1 having the above-mentioned configuration, the following effects are obtained.

(1) The oil level detection member 93 is located below the lower end of the oil filler opening. 92 in the inside of the transmission case 91 and protrudes inward from the inner wall 91*a*1 of the transmission case 91. Then, the tip part 93*a* thereof is located in a region visually recognizable from the outside of the oil filler opening 92. Further, the oil supply upper limit level L1 is located between the lower end surface 931 and the upper end surface 932 of the oil level detection member 93. Thus, the oil level in the inside of the transmission case 91 can be checked without use of an oil level gauge or the like.

(2) The oil level detection member 93 is provided in the inside of the transmission case 91. Thus, the necessity of an oil level gauge is avoided and hence the oil level detection mechanism can be constructed at a low cost in comparison with a case that an oil level gauge is provided.

(3) The oil supply upper limit level is located between the lower end surface 931 and the upper end surface 932 of the oil level detection member 93. Thus, even when oil is supplied to the upper limit, overflow of the oil through the oil filler opening 92 can be avoided.

(4) The oil level detection member 93 is formed integratedly with the transmission case 91. Thus, the oil level detection member 93 can be formed easily.

(5) The oil level detection member 93 is provided with the notch 933. Thus, the oil level in the inside of the transmission case 91 can be recognized visually in three dimensions through the notch 933.

(6) The notch 933 is formed such that the area of the upper end surface 933*b* is larger than the area of the lower end surface 933*a*. Thus, rise of the oil level in the inside of the notch 933 becomes gradual and hence oil level check is achieved more easily.

(7) Thickness d1 of the oil level detection member 93 is approximately 5 mm to 10 mm. Thus, in a state that the oil level can easily be recognized visually, an increase in the thickness d1 of the oil level detection member 93 is suppressed. Further, when the oil level detection member 93 has the thickness d1, satisfactory structural strength is ensured.

Figure 7:
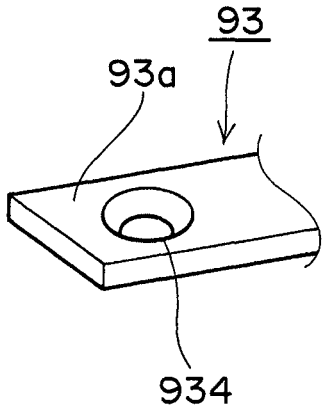
FIG. 7 is a perspective view of an oil level detection member provided with an opening.
Figure 8:
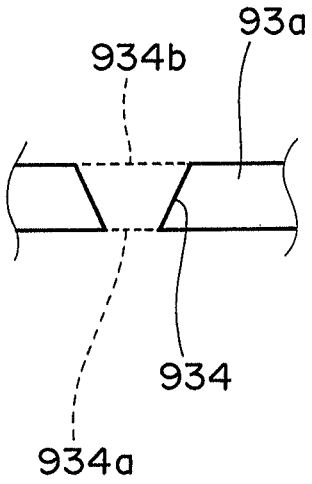
FIG. 8 is a sectional view of an oil level detection member shown in FIG. 7.

In the above-mentioned embodiment, the notch 933 has been formed in the oil level detection member 93. Instead, an opening may be formed. FIG. 7 is a perspective view of the oil level detection member 93 provided with an opening. As shown in FIG. 7, an opening 934 is formed in the tip part 93*a* of the oil level detection member 93. The opening 934 is formed by drilling or the like. FIG. 8 is a sectional view of the oil level detection member 93 shown in FIG. 7. As shown in FIG. 8, the opening 934 is formed such that the area of the upper end surface 934*b* thereof is larger than the area of the lower end surface 934*a* thereof.

According to the above-mentioned configuration, the opening 934 is formed such that the area of the upper end surface 934*b* is larger than the area of the lower end surface 934*a*. Thus, rise of the oil level in the inside of the opening 934 becomes gradual and hence oil level check is achieved more easily.

Figure 9:
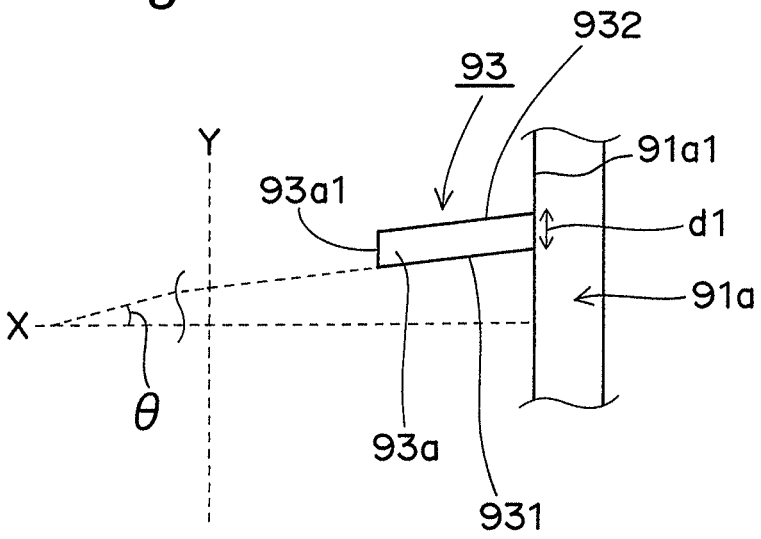
FIG. 9 is a side view of an oil level detection member provided in an inclined manner relative to a horizontal plane X.

In the above-mentioned embodiment, the oil level detection member 93 extends from the inner wall 91*a*1 of the transmission case 91*a* toward the inner side of the transmission case 91*a* and is approximately in parallel to the horizontal plane X. Instead, the oil level detection member 93 may be inclined relative to the horizontal plane X. FIG. 9 is a side view of the oil level detection member 93 provided in an inclined manner relative to the horizontal plane X. As shown in FIG. 9, the oil level detection member 93 extends from the inner wall 91*a*1 of the transmission case 91*a* toward the inner side of the transmission case 91*a* and is inclined downward relative to the horizontal plane X. Specifically, the oil level detection member 93 has an angle θ relative to the horizontal plane X.

According to the above-mentioned configuration, the oil level detection member 93 extends from the inner wall 91*a*1 toward the inner side of the transmission case 91 and is inclined downward relative to the horizontal plane X. Thus, rise of the oil level in the oil level detection member 93 becomes gradual. Further, by virtue of the inclination of the oil level detection member 93, the oil level can be recognized visually in three dimensions. Further, the oil gradually covers the upper face part of the oil level detection member 93. Thus, the oil level can easily be checked by virtue of a color difference between the ground of the oil level detection member 93 (white resulting from an aluminum material) and the oil (yellow).

The above-mentioned embodiment has been described for an example of the transmission case 91. However, the oil level detection mechanism of the present invention is not limited to an oil level detection mechanism in the inside of the transmission case 91. For example, the present technique may be applied to an oil level detection mechanism for a crankcase or a gear chamber into which engine oil is supplied in a vehicle.

In the above-mentioned embodiment, the oil level detection member 93 has been formed integratedly with the transmission case 91. Instead, the oil level detection member and the transmission case may be provided separately from each other and then the oil level detection member may be attached to the transmission case with screws, by welding, or the like.

In the above-mentioned embodiment, the front sheet 11 and the rear sheet 12 are of bench type. Instead, a box type may be employed.

Various modifications and changes may be made without departing from the spirit and the scope of the present invention described in the claims.

The invention claimed is:

1. An oil level detection mechanism for detecting an oil level in the inside of a case, comprising:

an oil filler opening through which oil is supplied into the case; and an oil level detection member that is as a whole located below a lower end of the oil filler opening in the inside of the case and that is attached to an inner wall of the case and protrudes inward from the inner wall so that a tip part thereof is located in a region visually recognizable from the outside of the oil filler opening.

2. The oil level detection mechanism according to claim 1, wherein the oil level detection member is formed integratedly with the case.

3. The oil level detection mechanism according to claim 1, wherein a notch or an opening is formed in the oil level detection member.

4. The oil level detection mechanism according to claim 3, wherein the notch or the opening is formed such that an area of an upper end surface thereof is larger than an area of a lower end surface thereof.

5. The oil level detection mechanism according to claim 1, wherein the oil level detection member extends from the inner wall toward an inner side of the case and is inclined downward relative to a horizontal plane.

6. An oil level detection mechanism for detecting an oil level in the inside of a case, comprising:

an oil filler opening through which oil is supplied into the case; and an oil level detection member that is as a whole located below a lower end of the oil filler opening in the inside of the case and that is attached to an inner wall of the case and protrudes inward from the inner wall of the case so that a tip part thereof is located in a region visually recognizable from the outside of the oil filler opening, wherein an oil supply upper limit level is located between a lower end surface and an upper end surface of the oil level detection member.

* * * * *